US005762118A

United States Patent [19]

Epworth et al.

[11] Patent Number: 5,762,118

[45] Date of Patent: Jun. 9, 1998

[54] APPARATUS AND METHOD FOR THE CORDLESS REMOTE CONTROL OF A FILLING FUNCTION OF A MOBILE VEHICLE

[75] Inventors: Roger W. Epworth, Perrineville; Michael Marley, Woodbridge, both of N.J.

[73] Assignee: I C E M Enterprises Inc., Perrineville, N.J.

[21] Appl. No.: 743,989

[22] Filed: Nov. 5, 1996

[51] Int. Cl.[6] ..... B65B 1/30

[52] U.S. Cl. ..... 141/198; 141/1; 141/94; 141/95; 141/231; 141/346; 340/450; 340/618

[58] Field of Search ..... 141/1, 94, 95, 141/198, 231, 346; 340/450, 618

[56] References Cited

U.S. PATENT DOCUMENTS

| | | | |
|---|---|---|---|
| 4,083,387 | 4/1978 | Stieber et al. | 141/95 |
| 4,688,587 | 8/1987 | Bourgeon | 141/95 |
| 4,934,419 | 6/1990 | Lamont et al. | 141/94 |
| 4,977,935 | 12/1990 | Durkee, Jr. et al. | 141/94 |
| 5,156,198 | 10/1992 | Hall | 141/94 |
| 5,249,612 | 10/1993 | Parks et al. | 141/94 |
| 5,460,210 | 10/1995 | Koeninger | 141/94 |
| 5,507,326 | 4/1996 | Cadman et al. | 141/198 |
| 5,624,344 | 4/1997 | Shukla et al. | 340/618 |
| 5,628,349 | 5/1997 | Diggins et al. | 141/95 |
| 5,649,577 | 7/1997 | Farkas | 141/198 |

*Primary Examiner*—J. Casimer Jacyna
*Attorney, Agent, or Firm*—Patrick J. Pinto

[57] ABSTRACT

An apparatus and method for the cordless remote control of a filling function of a mobile vehicle that includes a signal transmitter (12) and a liquid level sensor (14) that is mounted on a tank (18) of a mobile vehicle (16). The liquid level sensor (14) transmits a full signal to a remote signal receiver (22) by way of the signal transmitter (12). The full signal closes a control valve (26) interupting the flow of the fluid to the tank (18) by way of a conduit 28. An adjustable timer (44) provides a system safety back-up signal that closes the valve (26) if the full signal is not received within a preset time period. This apparatus and method can be operated in a semi-automatic mode or an automatic mode by the addition of an adjustable delay clock/timer (42). Audible and/or visual indicators are provided for monitoring the status of the filling operation.

20 Claims, 1 Drawing Sheet

APPARATUS AND METHOD FOR THE CORDLESS REMOTE CONTROL OF A FILLING FUNCTION OF A MOBILE VEHICLE

BACKGROUND OF THE INVENTION

1. Field of the Invention

With regard to the classification of art, this invention is believed to be found in the general class entitled Dispensing and more particularly to those subclasses pertaining to terminating the dispensing of a fluid by remote control signals.

2. Description of Related Art

The present invention is intended for use in the filling of a fluid reservoir of a mobile vehicle, such as an ice rink resurfacing machine. One known example of such a machine is disclosed in U.S. Pat. No. 3,622,205 that was issued on Nov. 23, 1971 to Zamboni.

In some instances these machines have more than one hot water tank or resurfacing fluid reservoir. The fluid capacity of a machine may be in the neighborhood of 757 liters (200 gal) of liquid. It can be appreciated that the time needed for filling the tank(s) or reservoir(s) may be considerable. Of course, the length of fill time is dependent on the rate of flow of the fluid, in liters per minute or gallons per minute. For example a 200 gal tank being filled at a rate between 22 gal per minute and 5 gal per minute will take between 9 minutes and 40 minutes to fill. The attention of the person monitoring the manual filling of the tank may be diverted to other tasks during the filling operation. It has been found that the time needed to finish those other tasks may exceed the filling time. In this scenario, the filling fluid is wasted or spilled through an overflow pipe and/or the filling aperture. This is not only wasteful of a treated resource but wastes the energy that was required, if the water had been heated. For example 5 minutes of overfilling at 22 gallons per minute would waste 110 gallons of water. In this same example, it is estimated that the cost of the wasted energy is in the neighborhood of $4.00. The typical ice skating rink may need to be resurfaced as much as 9 times a day. The waste in resources and energy could be considerable over a 7 day period and add to the overhead costs of operating an Ice Rink.

It has been determined that there is a need for a method and apparatus for controlling and monitoring the filling operation of the hot water tank or reservoir of these ice rink resurfacing machines. This method and apparatus should be adaptable for semiautomatic operation as well as automatic operation.

SUMMARY OF THE INVENTION

The present invention may be summarized with respect to its objects. It is an object of the present invention to provide and it does provide an apparatus and method for remotely controlling the filling operation of a mobile vehicle.

It is another object of this invention to provide and it does provide a method and apparatus that provides for unattended stopping of the flow of a filling fluid to a tank of the mobile vehicle as and when the tank is filled to a predetermined level.

It is still another object of this invention to provide and it does provide a method and apparatus for the unattended starting and stopping of the filling operation of a tank of a mobile vehicle.

It is yet another object of the present invention to provide and it does provide a method and apparatus for the remote filling of a tank of a mobile vehicle that provide audio and/or visual indication of its operational status.

One embodiment of the present invention may be briefly described as: an apparatus for the cordless remote control of a filling function for a mobile vehicle comprising: a) a signal transmitter that is mounted on a selected portion of a mobile vehicle; b) a liquid level sensing means that is attached to a fluid reservoir of the mobile vehicle, the liquid level sensing means being arrayed for detecting a predetermined level of fullness of the fluid reservoir, the liquid level sensing means being further adapted for providing a full signal to the signal transmitter as and when a level of a filling fluid reaches the predetermined level of fullness; c) a filler control assembly including a signal receiver, and a control valve, the signal receiver being arrayed for controlling the selective opening of the control valve; the control valve controlling the flow of a filling fluid from a supply source to the fluid reservoir of the mobile vehicle by way of a conduit, the conduit being removably placed into a filling aperture of the fluid reservoir, the filler control assembly further including at least one status indicating means for providing an audio and/or visual indication of its cycle status, and a user adjustable timer. The adjustable timer is arrayed for providing a terminate signal. The signal transmitter is battery powered for providing a cordless communication with the signal receiver. The cordless communication provides for the transmission of the full signal. The signal receiver places the control valve in an open condition upon receipt of an initiate signal so that the filling fluid flows to the fluid reservoir. The signal receiver subsequently closes the control valve, stopping the flow of the filling fluid to the fluid reservoir after receiving the full signal. The terminate signal closes the control valve if and when a full signal is not received within a predetermined period of time after receipt of the initiate signal.

Another embodiment of the present invention may include a delay timer/clock that is user adjustable and is adapted for initiating a fill cycle at a preset time of the day. This delay timer may also provide a display of the elapsed time for the filling operation as well as other functions.

The present invention may also be summarized as: a method for the cordless remote control of a filling function for a mobile vehicle comprising the steps of:

a) mounting a signal transmitter on a selected portion of a mobile vehicle;

b) attaching a liquid level sensing means to a fluid reservoir of the mobile vehicle, the liquid level sensing means being arrayed for detecting a predetermined level of fullness of the fluid reservoir, the liquid level sensing means being further adapted for providing a full signal to the signal transmitter as and when a level of a filling fluid reaches the predetermined level of fullness;

c) providing a filler control assembly, the filler control assembly including a signal receiver, and a control valve, the signal receiver being arrayed for controlling the selective opening of the control valve; the control valve controlling the flow of a filling fluid from a supply source to the fluid reservoir of the mobile vehicle by way of a conduit, the conduit being removably placed into a filling aperture of the fluid reservoir, the filler control assembly further including at least one status indicating means, and a user adjustable timer. The adjustable timer is arrayed for providing a terminate signal;

providing a cordless signal means for communication between the signal transmitter and the signal receiver for the transmitting of the full signal;

placing the control valve in an open condition upon receipt of an initiate signal from the signal receiver so that the filling fluid flows to the fluid reservoir: and subsequently closing the control valve for stopping the flow of the filling fluid to the fluid reservoir after receiving the full signal, the terminate signal closing the control valve if and when a full signal is not received within a predetermined period of time after the initiate signal.

In addition to the above summary, the following disclosure is intended to be detailed to insure adequacy and aid in the understanding of the invention. However, this disclosure, describing and showing particular embodiments of the invention, is not intended to describe each new inventive concept that may arise. These specific embodiments have been chosen to show at least one preferred or best mode for an apparatus and method of the present invention. These specific embodiments, as shown in the accompanying drawing, may also include diagrammatic symbols for the purpose of illustration and understanding.

Figure 1:
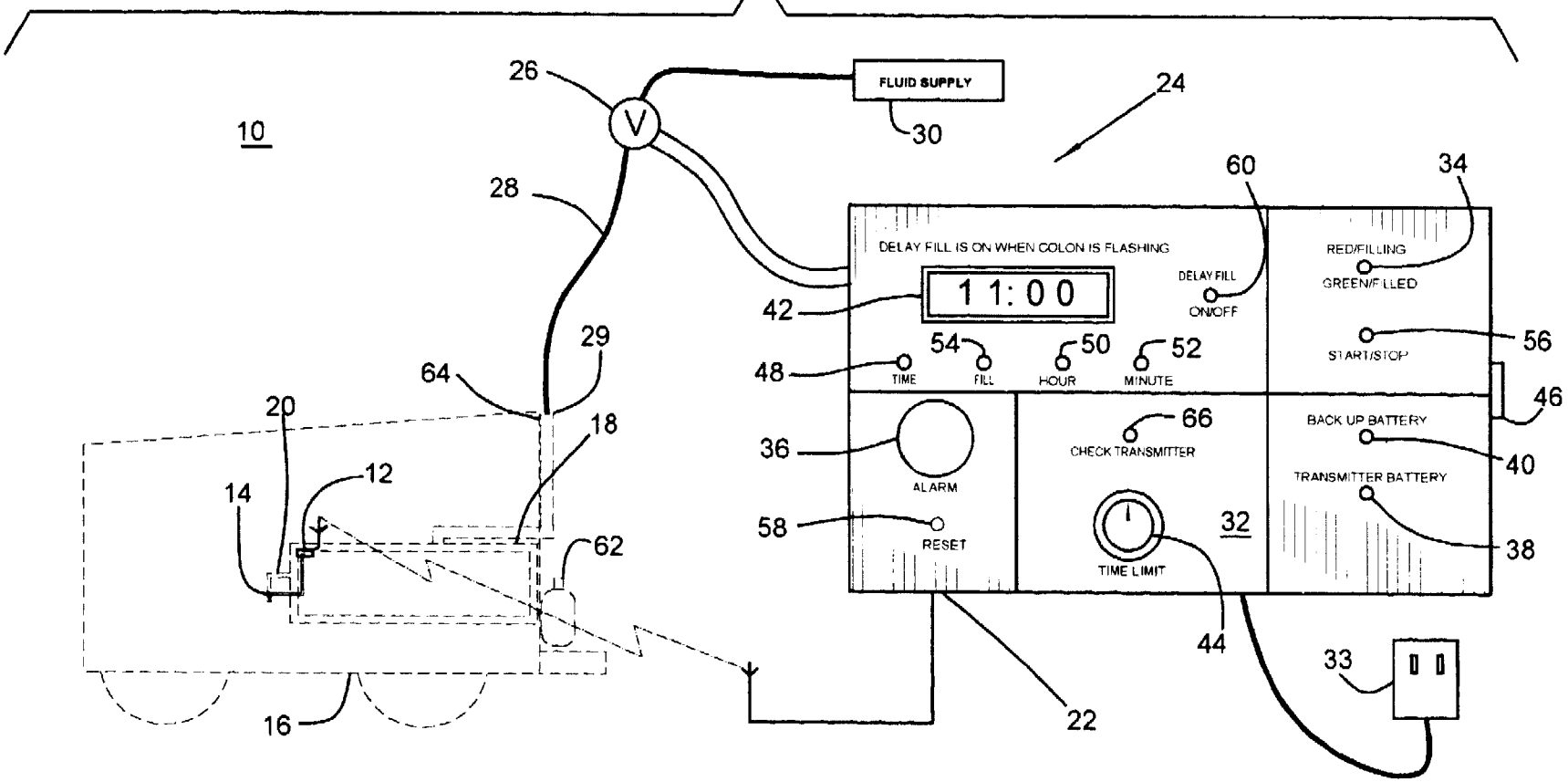
FIG. 1 represents a schematic diagram of a cordless remote control system of the present invention.

In the following description and in the appended claims, various details are identified by specific names for convenience. These names are intended to be generic in their application while differentiating between the various details. The corresponding reference numbers refer to like members throughout the drawing.

The drawings accompanying and forming a part of this specification disclose details of construction for the sole purpose of explanation. It is to be understood that structural details may be modified without departing from the concept and principles of the invention as claimed. This invention may be incorporated into other structural forms than shown.

DETAILED DESCRIPTION OF THE INVENTION

Referring to the drawing, there is depicted a remote control apparatus of the present invention, that is generally identified as 10. This remote control apparatus 10 includes a signal transmitter 12 that receives a signal from a liquid level sensing means 14. It is preferred that the signal transmitter 12 be battery powered and mounted on a mobile vehicle 16. The battery power for the signal transmitter may be self-contained or provided by a mobile vehicle 16, having an on-board storage battery system. The mobile vehicle 16, schematically shown in dashed outline, represents an ice rink resurfacing machine similar to the machine disclosed in U.S. Pat. No. 3,622,205.

The liquid level sensing means 14 is attached or mounted to a liquid reservoir or tank 18 of the mobile vehicle 16. The tank 18 is schematically shown in dashed outline inside the vehicle outline 16. This liquid level sensing means 14 is adjusted to provide a signal as and when a filling liquid has reached a predetermined level inside the tank 18. In retrofitting existing mobile vehicles 16, the liquid sensing means 14 may be mounted interior of a tank overflow pipe 20, as a replacement for or an adapter on a sight gauge, or at any convenient tank aperture. The liquid level sensing means 14 may be mounted to the tank at a predetermined convenient location on a newly engineered and constructed vehicle 16. Some examples of a level sensing means are: spaced electrodes, float switches, capacitance type, sonic type and the like. The sensing means 14 should use a minimum of power. A minimum power usage will avoid premature battery drain in a self contained battery operated signal transmitter 12.

The signal transmitter 12 may be mounted at any position on the vehicle provided that the integrity of an electrical connection is maintained between the signal transmitter 12 and the level sensing means 14. It is preferred that the signal transmitter be of the radio type and that its antenna be positioned for providing a clear signal to an antenna of the signal receiver and control module 22. The radio type is preferred due its omnidirectional properties, but other types such as Infrared may be used, but not limited thereto. The signal receiver and control module 22 is one of the components of a filler control assembly, that is generally identified as 24. Another component of the filler control system 24 is a solenoid operated control valve 26. It is preferred that this valve 26 be of a low voltage type for minimizing electrical hazards. This valve 26 should be capable of handling hot liquids when used in connection with an ice rink resurfacing machine. Some examples of a control valve 26 include normally closed versions of: a two-way poppet valve, a ball valve, a globe valve and the like. This control valve 26 is positioned intermediate the ends of a conduit 28 that carries the filling fluid from a source 30, to a filing aperture 29 of the tank 18. Some examples of a source 30 may include a water heater, a municipal water supply, a storage tank or the like. This control valve 26 controls the flow of the fluid through the conduit 28. The operation of the control valve 26 will be discussed below.

The signal receiver and control module 22 includes a control panel 32 that preferably includes: visual and/or audio status indicating means and input controls and is powered by an external low voltage transformer 33. The preferred status indicating means includes a filling indicator 34; multifunction signal or alarm 36, and transmitter battery status indicator 38. In the case where a signal receiver and control module 22 includes a battery backup, it is preferred that a low battery indicator 40 be provided.

The control panel 32 preferably includes a cycle delay timer 42. This cycle delay timer/clock 42 and its related logical circuitry is preferably capable of providing the time of day, time for delayed fill, elapsed fill times for prior fills, limit fill time; and system programming entry and review. In an automatically operated system, the delay cycle timer 42 should be user settable and resettable for inputting the desired time of day when automatic filling should begin. It is preferred that this cycle timer 42 include a digital display. The actuation of the digital display will also provide an indication that the internal circuitry of the receiver and control module 22 is energized.

It is preferred that an adjustable timer 44 be provided in the logic circuitry of the filler control assembly 24. This adjustable timer 44 is user settable for limiting the fill time to within a predetermined time period or limit. At the end of the time period, a terminate signal closes the control valve 26 by overriding the system by shutting off power thereto.

The control panel 32 includes various input devices such as toggle switches, push buttons and the like. These input devices include a power ON/OFF switch 46; TIME mode switch 48; HOUR set switch 50; MINUTE set switch 52; set FILL TIME switch 54; START/STOP switch 56; a RESET switch 58; and DELAY ON/OFF switch 60.

In addition to minimizing the waste of fluid and energy, the apparatus of the present invention has also provided an unexpected safety feature. That safety feature manifests itself in the fact that the present invention minimizes the loss of hot water, when the apparatus is operated in a manner as disclosed below. Some ice rink resurfacing machines 16 are powered by liquid gas or propane. The propane is stored in a tank or tanks 62 that are mounted near the filling aperture 29. Without the present invention, a great quantity of hot liquid may escape from the filling aperture 18 if high filling rates are used. The hot liquid has been known to cascade onto the propane tank 62. This cascading of the hot liquid onto the propane tank, if prolonged, may elevate the temperature of the tank to a point, where a pressure relief valve, not shown, on the tank 62 allows propane to escape into the surrounding atmosphere. This condition could be very hazardous in a confined area such as a maintenance room of an ice rink. The present invention, when installed and used on a machine, substantially eliminates the escape of propane into the atmosphere due to the spilling of hot water onto the tank 62.

The present apparatus may also be equipped with an interlock means 64 that is mounted at or near the filling end of the conduit 28. The interlock means 64 cooperates with the signal transmitter to enable the initiate signal when and only when the conduit is inserted into the filling aperture of the tank 18. One example of the interlock means includes a limit switch that detects the presence of the conduit, and the like.

The remote control system 10 of the present invention may be operated in a semiautomatic or immediate fill mode. In that Immediate fill mode, as a first step, an operator inserts the conduit 28 into the filing aperture 29 of the water tank 18. In a subsequent second step, the operator presses the START/STOP switch 56 which causes the fill status indicator 34 to glow red. In the third step of the cycle, the control system 10 now automatically controls the fill without any other intervention by the operator. The filling operation will stop by closing the control valve 26 after a full signal has been sent to the signal receiver and control module 22 from the signal transmitter 12; the fill status indicator 34 will glow green and an audible and/or visual alarm 36 will be energized. This full signal is determined by the level sensing means 14 as and when the fluid level reaches a predetermined degree of fullness of the tank 18. As a added safety, an output from the adjustable timer 44 is wired in series with the circuitry receiving the full signal. If the preset time of the adjustable timer is insufficient to provide a completely full tank, the control valve will be closed. In this situation, a status indicator 66 and/or alarm 36 are energized to indicate that the tank is not completely filled. This may also indicate that a malfunction has occurred somewhere in the system 10.

In the fully automatic or time delay mode, the operator again must first place the filling end of the conduit 28 into the filling aperture of the tank 18. Secondly, the time of day at which the initiate signal is to be given is entered into the cycle delay timer 42 if not previously set. This time delay mode may be monitored by actuating the FILL switch 54 and reading the digital display for the timer/clock 42. After the desired fill initiate time is entered into timer 42, the delay on/off switch 60 is place in the "ON" position. When the preset time of day approaches, the control system 24 first enables an audio warning alarm 36 and blinking red filling indicator 34 in anticipation of the opening of the valve, subsequently the control system opens the control valve 26 to allow fluid to flow into the tank 18. The balance of the operation is describe in the paragraph immediately above as the third step.

The RESET switch 58 resets the control module and extinguishes the green light 34 and silences alarm 36 after a fill cycle has been completed. It is anticipated that the operator may also be required to depress the RESET switch 58 prior to the initiation of the Immediate Fill or the Automatic Fill modes to avoid the unwanted or accidental dispensing of fluids from the conduit.

Directional terms such as "front", "back", "in", "out", downward, upper, lower and the like may have been used in the description. These terms are applicable to the embodiments shown and described in conjunction with the drawings. These terms are merely used for the purpose of description in connection with the drawings and do not necessarily apply to the position in which the present invention may be used.

While these particular embodiments of the present invention have been shown and described, it is to be understood that the invention is not limited thereto and protection is sought to the broadest extent that the prior art allows.

What is claimed is:

1. An apparatus for the cordless remote control of a filling function for a mobile vehicle comprising:

a) a signal transmitter that is mounted on a selected portion of a mobile vehicle, said signal transmitter being powered by a battery;

b) a liquid level sensing means that is attached to a fluid reservoir of the mobile vehicle, said liquid level sensing means being arrayed for detecting a predetermined level of fullness of the fluid reservoir, the liquid level sensing means being further adapted for providing a full signal to the signal transmitter as and when a level of a filling fluid reaches the predetermined level of fullness;

c) a filler control assembly including a signal receiver, and a control valve, the filler control assembly being arrayed for controlling the selective opening of the control valve; said control valve controlling the flow of a filling fluid from a supply source to the fluid reservoir of the mobile vehicle by way of a conduit, said conduit being removably placed into a filling aperture of said fluid reservoir, the filler control assembly further including at least one status indicating means, a user adjustable timer, and a delay cycle timer, said adjustable timer being arrayed for providing a terminate signal, said delay cycle timer being adapted for selectively sending the initiate signal at a predetermined time of day; and wherein said signal transmitter being powered by the battery for providing a cordless communication with said signal receiver, said cordless communication providing for the transmission of said full signal, said filler control assembly placing the control valve in an open condition upon receipt of an initiate signal so that the filling fluid flows to the fluid reservoir and said filler control assembly subsequently closing the control valve for stopping the flow of the filling fluid to the fluid reservoir after receiving said full signal, said terminate signal closing the control valve if and when a full signal is not received within a predetermined period of time after receipt of the initiate signal.

2. An apparatus as recited in claim 1 wherein the initiate signal is manually provided by the user in an immediate fill mode.

3. An apparatus as recited in claim 2 wherein the filling fluid is hot water and said apparatus provides for the unattended filling of a resurfacing vehicle for an ice skating rink while minimizing the waste of the filling fluid.

4. An apparatus as recited in claim 3 wherein said resurfacing vehicle is powered by a propane engine, and said apparatus minimizes the unintentional spilling of the hot water onto at least one propane fuel tank of the resurfacing vehicle thereby minimizing the leakage of propane from a safety valve of the fuel tank due to high temperature and a resultant high pressure interior of the fuel tank.

5. An apparatus as recited in claim 3 wherein said apparatus further includes an interlock means for detecting the presence of the conduit in the filling aperture, said interlock means providing a signal for enabling said initiate signal.

6. An apparatus as recited in claim 1 wherein the cordless communication between the signal transmitter and the signal receiver is by way of radio signals.

7. An apparatus as recited in claim 1 wherein a first of the status indicating means provides an indication that the control valve is about to be placed in the open condition.

8. An apparatus as recited in claim 7 wherein a second of the status indicating means provides an indication that the control valve is currently in the open condition.

9. An apparatus as recited in claim 8 wherein a third status indicating means providing for an indication that the control valve is currently in a closed condition.

10. An apparatus as recited in claim 1 wherein said conduit is a flexible conduit for conducting the fluid to the fluid reservoir of a resurfacing vehicle for ice skating surfaces.

11. An apparatus as recited in claim 10 wherein the filling fluid is hot water and said apparatus provides for the unattended filling of an ice rink resurfacing vehicle while minimizing the waste of the filling fluid.

12. An apparatus as recited in claim 11 wherein said resurfacing vehicle is powered by a propane engine, and said apparatus minimizes the unintentional spilling of the hot water onto at least one propane fuel supply tank of the resurfacing vehicle thereby minimizing the leakage of propane from a safety valve of the fuel tank due to high temperature and a resultant high pressure interior of the fuel tank.

13. An apparatus as recited in claim 11 wherein said apparatus further includes an interlock means for detecting the presence of the conduit in the filling aperture, said interlock means providing a signal for enabling said initiate signal.

14. An apparatus as recited in claim 11 wherein said cordless communication between the signal transmitter and the signal receiver is by way of radio signals.

15. An apparatus as recited in claim 14 wherein a first of the status indicating means provides an indication that the control valve is about to be placed in the open condition.

16. An apparatus as recited in claim 15 wherein a second of the status indicating means provides an indication that the control valve is currently in the open condition.

17. An apparatus as recited in claim 16 wherein a third status indicating means provides for an indication that the control valve is currently in a closed condition.

18. A method for the cordless remote control of a filling function for a mobile vehicle comprising:

a) mounting a signal transmitter on a selected portion of a mobile vehicle, said mobile vehicle being an ice rink resurfacing vehicle, said signal transmitter being powered by a battery;

b) attaching a liquid level sensing means to a resurfacing fluid reservoir of the ice rink resurfacing vehicle, the liquid level sensing means being adapted for providing a full signal to the signal transmitter as and when a level of a filling fluid fills the resurfacing fluid reservoir;

c) providing a filler control assembly, the filler control assembly including a signal receiver, and a control valve, the filler control assembly being arrayed for controlling the selective opening and closing of the control valve; said control valve controlling the flow of a resurfacing fluid from a supply source to the resurfacing fluid reservoir of the ice rink resurfacing vehicle by way of a flexible conduit, said flexible conduit having a filling end, said flexible conduit being removably placed into a filling aperture of said resurfacing fluid reservoir, the filler control assembly being mounted at a location other than on said ice rink resurfacing vehicle and simultaneously near a second end of said flexible conduit, said filler control assembly further including at least one status indicating means;

d) providing a cordless radio type communication between the signal transmitter and the signal receiver for the omnidirectional transmission of said full signal;

e) placing the control valve in an open condition upon receipt of an initiate signal placed at the filler control assembly so that the filling fluid flows to the fluid reservoir;

f) subsequently closing the control valve for stopping the flow of the resurfacing fluid to the fluid reservoir after the signal receiver receives said full signal; and g) removing the filling end of said flexible conduit from the resurfacing fluid reservoir, said signal transmitter remaining mounted on the ice rink resurfacing vehicle absent any physical attachment to said filler control assembly during operation of said ice rink resurfacing vehicle.

19. The method as recited in claim 18 which further includes the steps of providing a user adjustable timer for providing a terminate signal; and closing the control valve upon receipt of the terminate signal prior to the receipt of the full signal.

20. A method as recited in claim 18 which further includes the step of providing an adjustable timer in the filler control assembly, said adjustable timer being arrayed for limiting the fill time to within a predetermined period of time, said period of time beginning simultaneously with the placing of the control valve in an open condition.

* * * * *